United States Patent [19]

Weidmann

[11] B 3,998,248

[45] Dec. 21, 1976

[54] WEFT BAND WITH CARRIER FOR LOOPER LOOMS

[75] Inventor: Erwin Weidmann, Ruti, Switzerland

[73] Assignee: Ruti Machinery Works Ltd., Ruti, Switzerland

[22] Filed: Nov. 25, 1974

[21] Appl. No.: 527,171

[44] Published under the second Trial Voluntary Protest Program on March 9, 1976 as document No. B 527,171.

[30] Foreign Application Priority Data

Dec. 4, 1973 Switzerland ..... 16993/73

[52] U.S. Cl. ..... 139/449; 139/444

[51] Int. Cl.[2] ..... D03D 47/18

[58] Field of Search ..... 139/122 N, 122 R, 123, 139/127 R

[56] References Cited

UNITED STATES PATENTS

| | | | |
|---|---|---|---|
| 2,151,085 | 3/1939 | Dewas | 139/123 |
| 2,477,357 | 7/1949 | Whitin | 139/123 |
| 2,548,663 | 4/1951 | Fletcher et al. | 139/123 |
| 3,088,497 | 5/1963 | Guindon | 139/122 N |
| 3,159,184 | 12/1964 | Brown, Jr. et al. | 139/122 R |
| 3,272,237 | 9/1966 | Consoletti | 139/122 N |
| 3,517,705 | 6/1970 | McClure, Jr. | 139/122 R |
| 3,669,155 | 6/1972 | Dewas | 139/123 |

*Primary Examiner*—James Kee Chi
*Attorney, Agent, or Firm*—Donald D. Denton

[57] ABSTRACT

A weft band with carrier for looper looms in which the weft band has a material recess or recesses in the area of the connection of the weft band to the looper.

7 Claims, 6 Drawing Figures

2
3
4
5
6
7
8
9
10
11
12

WEFT BAND WITH CARRIER FOR LOOPER LOOMS

BACKGROUND

The present invention relates to a weft band with a carrier or looper for looper looms.

Normally loopers are undetachably or permanently connected with the particular end of the weft band by soldering or the like. Practice has shown that in operation such weft bands frequently break in the immediate vicinity of their connection area with the looper, because on the one hand the weft band ends passing into and out of the shed with the looper are subject to elevated vibratory stresses, and on the other hand have at this particular point undergone a material structural change caused by the heat action during soldering, by means of which a weakened or breakage zone has formed.

SUMMARY

The problem of the present invention is therefore to provide a weft band with looper wherein the above-indicated weakened or breakage zone can be bridged.

According to the invention, this problem is solved by providing the weft band with at least one material recess means in the zone in the vicinity of the connecting area of the weft band with the looper.

It will be appreciated that such a material recess means can be obtained in various ways. This material recess can advantageously be a groove extending at right angles to the longitudinal direction of the band on the top thereof. In addition, the material recess means can define an approximately teardrop-shaped opening or a slot or a constriction. Also, the material recess means can define a plurality of spaced holes arranged in the longitudinal direction of the band whose diameter appropriately decreases in sequence away from the connecting area of the band.

As a result of the above improvements, there is provided a means to remove the load from the breaking zone which has hitherto existed and in such an effective manner that no further breaking can occur because of vibratory stressing since it is substantially displaced into the zone of the material recess means. In this connection, it has surprisingly been found that no breaks occur in the breakage zone with the material recess means provided in the weft band. This result is obviously due to the higher band elasticity in this zone obtained because of the appropriate type of material recesses provided in this zone.

BRIEF DESCRIPTION OF THE DRAWINGS

These and other objects of the present invention will be apparent from the following description and claims, and are illustrated in the accompanying drawings which by way of illustration show preferred embodiments of the present invention and the principles thereof, and what are now considered to be the best modes contemplated for applying these principles. Other embodiments of the invention embodying the same or equivalent principles may be used, and structural changes may be made as desired by those skilled in the art without departing from the present invention and the scope of the appended claims. In the drawings:

DESCRIPTION OF THE PREFERRED EMBODIMENTS

Figures 1, 1A, 1B, 1C, 1D, 1E:
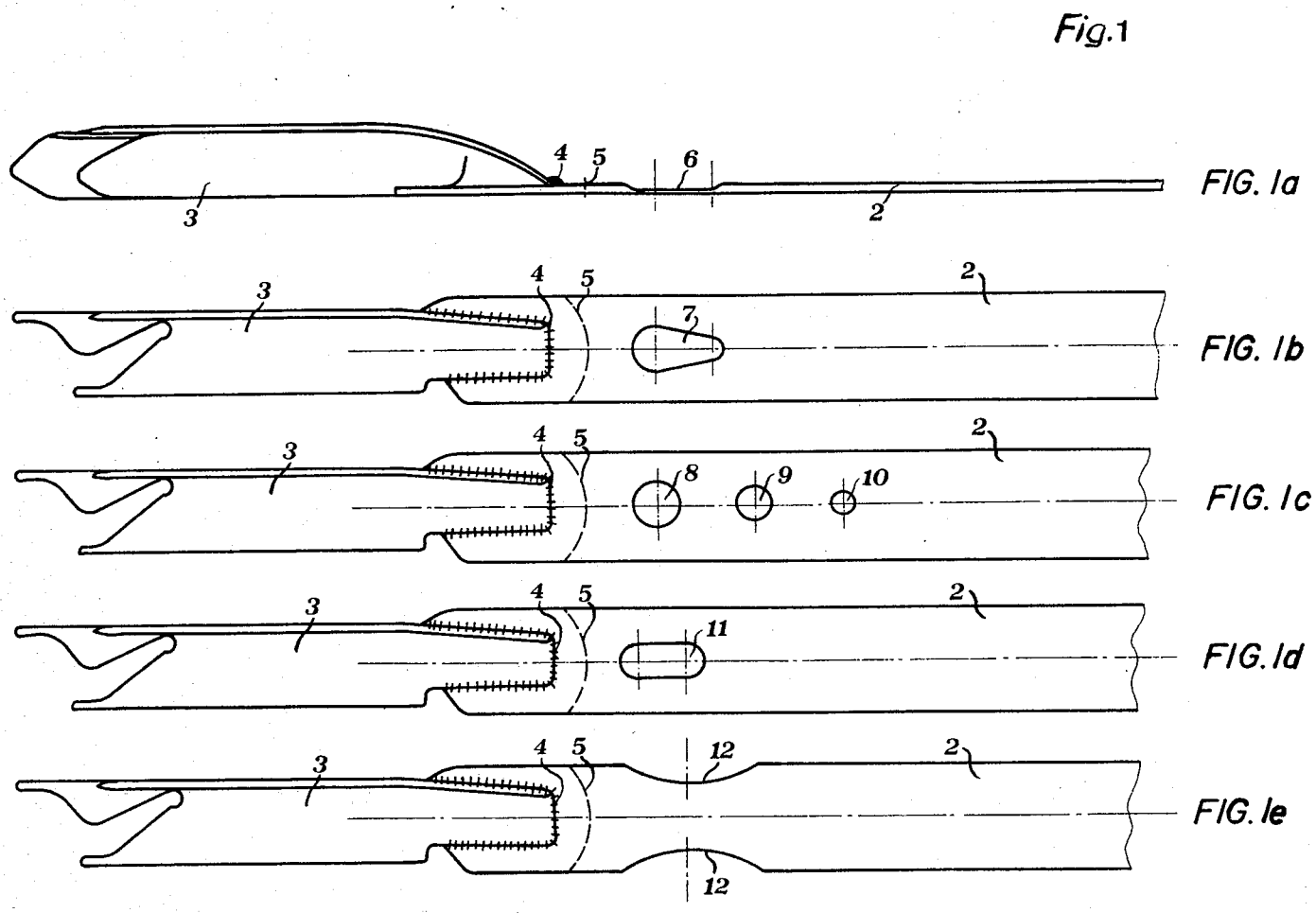
FIG. 1*a* shows a side view of a cut-away portion of a weft band with a looper.
FIG. 1*b* shows a plan view of a further embodiment of the weft band with looper in which the weft band has a teardrop-shaped opening therein.
FIG. 1*c* shows a plan view of a further embodiment of the weft band with looper in which the weft band has a plurality of spaced holes therein.
FIG. 1*d* shows a plan view of a further embodiment of the weft band with looper in which the weft band has a slot therein.
FIG. 1*e* shows a plan view of a further embodiment of the weft band with looper in which the weft band has two concave indentations.

The drawings illustrate the looper attachment end of a weft band 2 of a looper loom, with which band is undetachably or permanently connected a looper 3, in the present case by solder joint 4. In the same way, the looper can also be detachably connected with the weft band, whereby an assembly plate is then soldered to the latter so that relative to the risk of breakage on the band substantially the same problems occur. A weft band with a detachably connected looper forms the object of a parallel application of the same applicant.

As indicated hereinbefore, with weft bands with loopers of the type indicated hereinbefore there is an increased danger of band breakage in the immediate proximity of the connecting area between band and looper, whereby in the drawings this area terminates at soldered joint 4. The area with increased breakage risk is designated in the drawings by dash line 5.

As can be seen in the drawings, the weft band 2 is provided with at least a material recess means in an area which is close to the connecting area 4 or the breakage or weakened area 5, whereby as indicated hereinbefore this material recess means effectively prevents the band breakages which have hitherto occurred. The area or zone designated by the material recess means can be called the elasticity zone or vibration zone, and the recess means can be one or more grooves, holes, indentations, and the like.

In the embodiment according to FIG. 1*a*, the material recess means is a groove 6 running at right angles to the longitudinal direction of the band 2 on the top thereof in the said vibration zone, whereby the transition edges of the said groove are preferably chamfered or curved.

In the embodiment according to FIG. 1*b*, an approximately teardrop-shaped opening 7 is defined in the said vibration zone whose widened portion is located closer to the connecting area 4.

In a further embodiment according to FIG. 1*c*, three holes 8, 9, 10 spacedly arranged along the centerline and in the longitudinal direction of band 2 are provided in the vibration zone, whereby the diameters of the said holes decrease sequentially away from the connecting area 4.

FIG. 1*d* illustrates an embodiment wherein only a single slot 11 is provided in the oscillation zone of the weft band.

FIG. 1*e* shows a further embodiment wherein the edges of the weft band 2 provided with concave indentations or cut-away portions 12 in the area of the said vibration zone, in such a way that at this point a constriction is formed on the band.

It has been shown that the above improvements provided by the invention can be realized in simple manner and can also be applied subsequently to existing weft bands.

While there has been described and illustrated the preferred embodiments of the invention, it is to be understood that these are capable of variation and modification, that the material recess means may have a variety of shapes and forms, and that the invention is not to be limited to the precise details set forth but is to include such modifications and alterations as fall within the scope of the appended claims.

I claim:

1. A weft band attached at one end thereof with a yarn carrier having a connecting area therebetween, said weft band and connected yarn carrier used for inserting weft threads into sheds during the operation of a loom, said weft band having a first section defining a vibration zone adjacent to said connecting area separated by a relatively small distance from the rear end of said carrier and a second section bordering on said first section, said weft band having a reduction in material in said first section in relation to said second section to produce a substantial decrease in the stress in said connecting area when said weft band and yarn carrier are in operation.

2. The weft band according to claim 1 wherein said reduction in material includes at least one material recess.

3. The weft band according to claim 1 wherein the reduction in material is produced by a groove running at right angles to the longitudinal direction of the band on the top thereof.

4. The weft band according to claim 1 wherein the reduction in material is produced by an approximately teardrop-shaped opening with the bottom of the teardrop facing said connecting area.

5. The weft band according to claim 1 wherein the reduction in material is produced by a plurality of spaced holes arranged in the longitudinal direction of the band, whose diameters sequentially decrease away from the connecting area.

6. The weft band according to claim 1 wherein the reduction in material is produced by a slot.

7. The weft band according to claim 1 wherein the reduction in material is produced by a constriction.

* * * * *